US005709770A

United States Patent [19]

Asghar et al.

[11] Patent Number: 5,709,770

[45] Date of Patent: Jan. 20, 1998

[54] APPARATUS FOR DECORATING ARTICLES VIA HEAT TRANSFER LABELLING

[75] Inventors: Syed A. Asghar, Brockton; Joseph F. Callinan, Natick, both of Mass.

[73] Assignee: Avery Dennison Corporation, Pasadena, Calif.

[21] Appl. No.: 397,078

[22] PCT Filed: Aug. 31, 1993

[86] PCT No.: PCT/US93/08191

§ 371 Date: May 17, 1995

§ 102(e) Date: May 17, 1995

[87] PCT Pub. No.: WO94/05515

PCT Pub. Date: Mar. 17, 1994

Related U.S. Application Data

[63] Continuation-in-part of Ser. No. 938,929, Aug. 31, 1992, abandoned.

[51] Int. Cl.[6] ..... B65C 9/18; B65C 9/24; B65C 9/30; B41F 17/18

[52] U.S. Cl. ..... 156/447; 156/449; 156/458; 156/456; 156/542; 156/DIG. 11; 156/DIG. 12; 156/DIG. 13; 156/DIG. 18; 156/DIG. 21; 156/DIG. 25; 156/DIG. 26; 156/DIG. 33; 156/DIG. 51; 101/36; 101/37; 101/38.1; 101/39; 101/40

[58] Field of Search ..... 156/447, 449, 156/456, 542, 458, DIG. 8, DIG. 11, DIG. 12, DIG. 13, DIG. 14, DIG. 18, DIG. 21, DIG. 25, DIG. 26, DIG. 33, DIG. 51; 101/36, 37, 38.1, 39, 40

[56] References Cited

U.S. PATENT DOCUMENTS

| | | | |
|---|---|---|---|
| 2,981,432 | 4/1961 | Flood | 216/2 |
| 3,111,446 | 11/1963 | Flood | 156/475 |
| 3,139,368 | 6/1964 | Flood | 156/475 |
| 3,208,897 | 9/1965 | Flood | 156/475 |
| 3,313,667 | 4/1967 | Flood | 156/230 |
| 3,483,063 | 12/1969 | Bains et al. | 156/517 |
| 3,524,786 | 8/1970 | Spokowski et al. | 156/447 |
| 3,861,986 | 1/1975 | Wochner | 156/567 |
| 4,242,167 | 12/1980 | Hoffman | 156/357 |
| 4,300,974 | 11/1981 | Bauer | 156/360 |
| 4,332,635 | 6/1982 | Holbrook et al. | 156/256 |
| 4,452,659 | 6/1984 | Guertsen et al. | 156/361 |
| 4,735,664 | 4/1988 | Asghar et al. | 156/64 |
| 4,860,197 | 8/1989 | Harvey | 156/449 |
| 4,927,709 | 5/1990 | Parker | 428/352 |
| 5,244,530 | 9/1993 | Collins et al. | 156/519 |

*Primary Examiner*—David A. Simmons
*Assistant Examiner*—J. A. Lorengo
*Attorney, Agent, or Firm*—Kriegsman & Kriegsman

[57] ABSTRACT

An apparatus for applying heat transfer labels, disposed on a web, to containers. In one embodiment, the apparatus is intended for round, non-tapered containers and comprises a continuously rotating turret, a container transport system for continuously delivering containers to and away from the turret and a web transport system for moving a web containing heat-transfer labels into position for label transferring. The turret includes a rotably driven shaft and a plurality of cup assemblies arranged in a circle around the shaft and coupled thereto. Each cup assembly includes a cup used to hold a container, the cup being rotably driven independently of the shaft and in a required direction. A nozzle assembly is associated with each cup assembly and is used to secure a container within its respective cup and, if necessary, to inflate the container to impart sufficient rigidity thereto for labelling. Each cup assembly and its associated nozzle assembly together define a container holding station. The turret also includes a plurality of transfer assemblies arranged in a circle around the shaft and spaced radially inwardly from the container holder stations, each transfer assembly being associated with a corresponding container holding station. Each transfer assembly includes a heater/platen and a transfer roller. The heater/platen is mounted on a cam follower which is adapted to ride along a cam rail. The cam rail is of an appropriate length so that at least cam follower may not be riding therealong at one time. Each transfer roller is connected to its associated heater/platen in such a way that, when the cam follower is not riding along the cam rail, the transfer roller is urged radially outwardly in such a way as to transfer a label from the web onto a container.

8 Claims, 9 Drawing Sheets

APPARATUS FOR DECORATING ARTICLES VIA HEAT TRANSFER LABELLING

The present application is a continuation-in-part of U.S. patent application Ser. No. 07/938,929, filed 31 Aug. 1992, now abandoned.

TECHNICAL FIELD

The present invention relates generally to a method and apparatus for decorating containers and the like and more particularly to a method and apparatus for decorating containers with heat-transfer labels transferred from a web.

BACKGROUND ART

Many types of methods and apparatuses are well known for decorating containers and the like, with heat-transfer labels disposed on a web. With virtually all such methods and apparatuses, a primary consideration has been to maximize the throughput of the containers being decorated in the apparatus. Other considerations have been to minimize the cost of equipment, to minimize maintenance difficulties with equipment and to maximize the quality of the decorating operation.

In commonly-assigned U.S. Pat. No. 4,735,664 to Asghar et al., there is disclosed a decorator controlled by a signal processor for applying heat transfer labels and the like to articles. Servo circuits accept processor commands and direct operation of label feed and transfer elements. A transfer roller moves in a continuously variable manner to follow the contour of the article surface. A position roller precisely matches web movement to article movement, or enables controlled stretching or shrinking of the labels as they are applied to articles. A turret loads, indexes, and unloads articles for label application at two decorating sites. Indexing of the articles takes place as the turret is rotated.

The throughput of the aforementioned decorator is limited by the fact that movement of the turret must be stopped at the two decorating sites so that labels can be applied to the articles transported thereto.

In commonly-assigned U.S. Pat. No. 4,253,904 to Jodrey et al., there are disclosed a method and an apparatus for the decoration of bottles and the like at high speeds. Bottles are delivered by an input conveyor to a star wheel, which deposits them sequentially into a continuously rotating turret. The turret carries the bottles past a labelling site, where a label carrier strip is pressed into contact with a bottle surface and a label thereby transferred. The shape of the bottle is maintained during labelling by means of inflation of the bottles through an inserted nozzle. The raising and lowering of the inflating nozzle and the flow of inflating air is controlled by special valving apparatus. The motion of the label carrier strip past the labelling site is regulated by the use of rolls on a shuttle slide, which in turn is reciprocated by a second slide driven by a conjugate cam. This results in an increase of the local velocity of the carrier strip during most of the cycle, and a slowing of the strip during the balance. After labelling, the inflating nozzle is retracted from the bottle and the bottle is removed by a second star wheel for further processing.

The throughput of the aforementioned apparatus is limited by the fact that it includes only one roller for transferring a label onto an article. Consequently, only one article can be decorated with a label at any given time.

In U.S. Pat. No. 4,239,569 to Harvey, there are disclosed an apparatus for and a method of applying heat transferable labels from a web onto a hollow article. The articles to be decorated pass through the apparatus continuously with the label being applied without any stoppage or other intermittent motion imparted to the article being decorated. The articles are conveyed to a receptacle holding means which receives and holds the article while passing through the decorating station. The label carrying web, which is driven through the decorating station, is heated both at and prior to the decorating station to facilitate transfer without the necessity of interrupting either the movement of the label carrying web or article to be decorated.

The throughput of the aforementioned apparatus is limited by the fact that it includes only enough rollers to transfer one or more labels onto a single article at any given time.

In commonly-assigned U.S. Pat. No. 3,861,986 to Wochner, there are disclosed a method and an apparatus for applying heat transfer labels from a web or backing strip to a bottle or container. The labels which are positioned one after another on the backing strip are applied to the bottles or containers at a plurality of labelling stations, one turret being at each labelling station, such that at a first station a first label from a sequence of labels is transferred and at a second station positioned downstream from the first station a subsequent label of the sequence of labels is then transferred.

The throughput of the aforementioned apparatus is limited by the fact that, at each labelling station, there is only one roller associated with each turret for transferring a label onto an article. Consequently, only one article at each labelling station can be labelled at one time. The turret motion is of the start/stop type such that during the non-decorating period, a label for the second transfer station is fed through.

DISCLOSURE OF INVENTION

It is an object of the present invention to provide a new and novel method and apparatus for decorating containers with heat-transfer labels disposed on a web.

It is another object of the present invention to provide a method and apparatus as described above which overcomes at least some of the shortcomings described above in connection with existing methods and apparatuses.

Additional objects of the invention, as well as features and advantages thereof, will be set forth in part in the description which follows, and in part will be obvious from the description or may be learned by practice of the invention. The objects of the invention also may be realized and attained by means of the instrumentalities and combinations particularly pointed out in the appended claims.

According to a first preferred embodiment of the invention, an apparatus is provided for applying heat-transfer labels, disposed on a web, to round, non-tapered containers. The apparatus of this preferred embodiment comprises a continuously rotating turret where decoration of the containers takes place, a container transport system including a feed screw and a pair of starwheels for continuously delivering containers to and away from the turret before and after decoration, respectively, and a web transport system for moving a web containing heat-transfer labels into position for label transferring.

The turret of this embodiment includes a rotatable central shaft and a plurality of cup assemblies arranged in a circle around the rotatable central shaft and fixedly coupled thereto. Each cup assembly is used for holding a container to be decorated and includes a base and cup rotably mounted on the base, the cup being rotably driven independently of the central shaft of the turret and in a direction opposite thereto. A nozzle assembly is associated with each cup assembly and is used to secure a container within its respective cup and, provide if necessary, means for inflating the container to impart sufficient rigidity thereto for labelling. Each cup assembly and its associated nozzle assembly together define a container holding station.

The turret of this embodiment also includes a plurality of transfer assemblies arranged in a circle around the rotatable central shaft and spaced radially inwardly from the container holding stations, each transfer assembly being associated with a corresponding container holding station and together defining a decorating station. Each transfer assembly includes a heater/platen and a transfer roller. The heater/platen is mounted on a cam follower which is adapted to ride along a cam rail. The cam rail is of an appropriate length so that two or more cam followers may be riding therealong at one time. Each transfer roller is connected to its associated heater/platen in such a way that, when the cam follower is not riding along the cam rail, the transfer roller is urged radially outwardly against the web in such a way as to transfer a label from the web onto a container.

One particularly desirable feature of the above-described apparatus is that both the container transport system and the turret are designed so that each container moves continuously (in a translational sense) from the beginning of the apparatus to the end thereof, thereby contributing to a maximization of the throughput of containers decorated by the apparatus.

Another particularly desirable feature of the above-described apparatus is that the turret is provided with a plurality of transfer rollers which are arranged and actuated in such a way so that at least one transfer roller and preferably at least two may be used at any one time as part of the decoration process. In this manner, two or more containers may be decorated at once, thereby also contributing to a maximization of the throughput of containers decorated by the apparatus.

According to a second preferred embodiment of the invention, an apparatus is provided for applying heat-transfer labels, disposed on a web, to round, tapered containers. The apparatus of this preferred embodiment is essentially the same as the apparatus of the first preferred embodiment, the primary difference between the two apparatuses being that the decorating stations of the second preferred embodiment each include a nozzle which is adapted for pivotal movement about a horizontal axis as well as axial movement and each include a camming arrangement for tipping the round, tapered container to an appropriate position parallel to its associated transfer roller.

According to a third preferred embodiment of the invention, an apparatus is provided for applying heat-transfer labels, disposed on a web, to oval-shaped containers. The apparatus of this embodiment includes a stationary, i.e. non-rotatable, label transfer wheel. Two label transfer assemblies are disposed around the periphery of the label transfer wheel, 180 degrees apart, and are mounted on the label transfer wheel by a suitable camming mechanism so that they can be cammed radially inward and outward relative to the center of the label transfer wheel. The apparatus also includes a web transport system for continuously moving a web having heat-transfer labels disposed thereon around the transfer wheel. The web, which preferably contains labels for the front and rear of an oval shaped container, is wrapped around an arcuate portion of the periphery of the label transfer wheel which contains the two label transfer assemblies. The apparatus further includes means for continuously conveying containers to and from the label transfer assemblies, the conveying means including an infeed conveyor, a continuously moving main conveyor having a double S-shaped configuration, a continuously rotating feedscrew, a first continuously rotating starwheel turret, a 180 degree container turner, a second continuously rotating starwheel turret and an exit conveyor. Each starwheel turret includes a starwheel having a plurality of pockets, each for receiving a container and a plurality of nozzle assemblies, one for each pocket. As a container in each starwheel turret moves toward its corresponding label transfer assembly, the nozzle assembly directly above engages the container to hold it in place and provides air, if needed, for inflation.

According to a fourth preferred embodiment of the invention, an apparatus is provided for applying heat-transfer labels, disposed on a web, to flat containers. The apparatus of this embodiment includes a stationary label transfer wheel having a pair of label transfer assemblies which can be cammed radially in and out by any suitable camming means. A web transport system identical to that used in the third preferred embodiment described above is used to move the web carrying the heat-transfer labels. A nozzle arm wheel is mounted for rotation about the center of the label transfer wheel in the same direction of movement of the web, and a plurality of nozzle arm assemblies are mounted on the nozzle arm wheel. Each nozzle arm assembly is adapted to hold a flat container and also to turn the container 180 degrees when appropriate. The apparatus also includes means for continuously conveying the containers to and from the label transfer wheel, said conveying means including an infeed conveyor, a main conveyor, a timing screw along the path of the main conveyor and an exit conveyor.

According to a fifth preferred embodiment of the invention, an apparatus is provided for applying heat-transfer labels, disposed on a web, to round, non-tapered containers. The apparatus of this embodiment includes a container positioning system for positioning containers at conveying and decorating stations, at least one web module for registration and application of labels and a container transport system for continuously transporting containers to and from the container positioning system. The container positioning system includes a link type chain or other type of conveyor means such as a belt or a band for moving containers along a closed loop path. The chain is mounted at one end on a drive wheel and at the other end on a tension wheel. A plurality of container holding assemblies, each constructed to hold a container and rotate the container about its central axis are attached to the chain at equally spaced apart distances. Each web module includes a label transfer assembly which, in turn, includes a rotably mounted wheel having a plurality of assemblies which can be cammed radially inward and outward by suitable camming means and a plurality of nozzle assemblies for capturing containers when they arrive at the wheel. The two web modules may be used, if desired, to apply one label to the neck portion of the container and one label to the body portion of the container. As can be appreciated, additional web modules may be added, if desired, and the length of the chain can be easily increased, if desired.

According to a sixth preferred embodiment of the invention, an apparatus is provided for applying heat-transfer labels, disposed on a web, to oval-shaped containers. The apparatus differs primarily from the apparatus of the fifth embodiment in that the tension wheel is replaced with a combination tension wheel and container turner and that additional web modules have been added. If desired, certain of the web modules can be used as auxiliary modules which are only activated when another module runs out of web material or requires repair.

According to a seventh preferred embodiment of the invention, an apparatus is provided for applying heat-transfer labels, disposed on a web, to flat containers. The apparatus differs primarily from the apparatus of the sixth embodiment in that the link chain travels a straight path between the drive wheel and combination tensioner and container turner.

As is apparent, the fifth embodiment described above can be easily converted to either the sixth or the seventh embodiment, if so desired.

BRIEF DESCRIPTION OF DRAWINGS

The accompanying drawings, which are hereby incorporated into and constitute a part of this specification, illustrate the preferred embodiments of the invention and, together with the description, serve to explain the principles of the invention. In the drawings wherein like reference numerals represent like parts.

BEST MODE(S) FOR CARRYING OUT THE INVENTION

Figure 1:
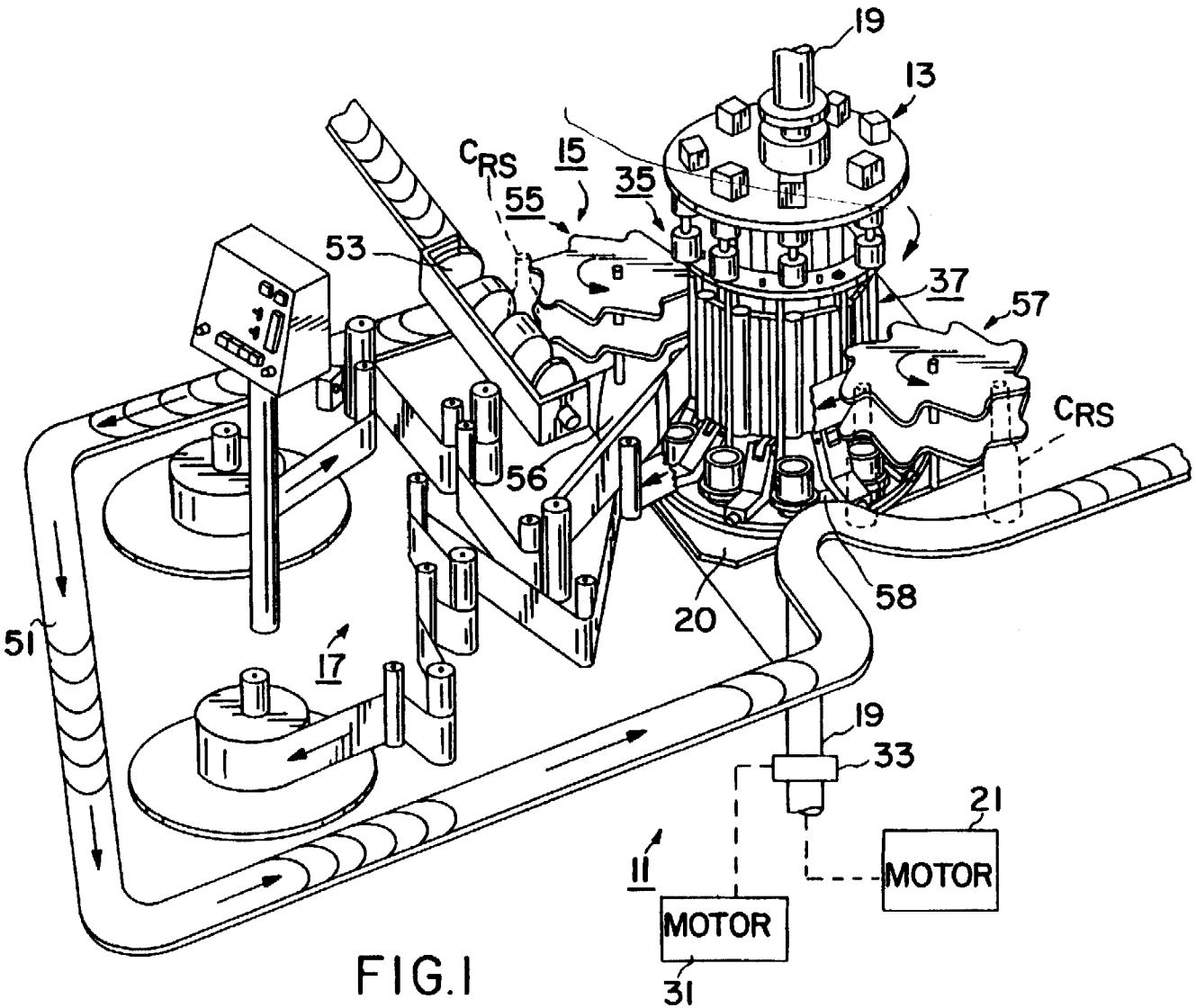
FIG. 1 is a simplified perspective view of an apparatus constructed according to this invention for applying heat transfer labels to containers which are round and straight.

Referring now to the drawings, there is shown in FIG. 1 a simplified perspective view of an apparatus constructed according to this invention for use in applying heat-transfer labels disposed on a web to round, straight containers $C_{RS}$, i.e. containers which are round and non-tapered in cross-section, the apparatus being identified by reference numeral 11. Containers $C_{RS}$ may be either rigid or non-rigid in construction.

Apparatus 11 includes a continuously rotating turret 13 where decoration of containers $C_{RS}$ takes place, a container transport system 15 for delivering containers $C_{RS}$ to turret 13 for decoration and carrying away containers $C_{RS}$ from turret 13 after decoration and a web transport system 17 for moving a web WA containing heat transfer labels into position for label transferring.

Figure 2:
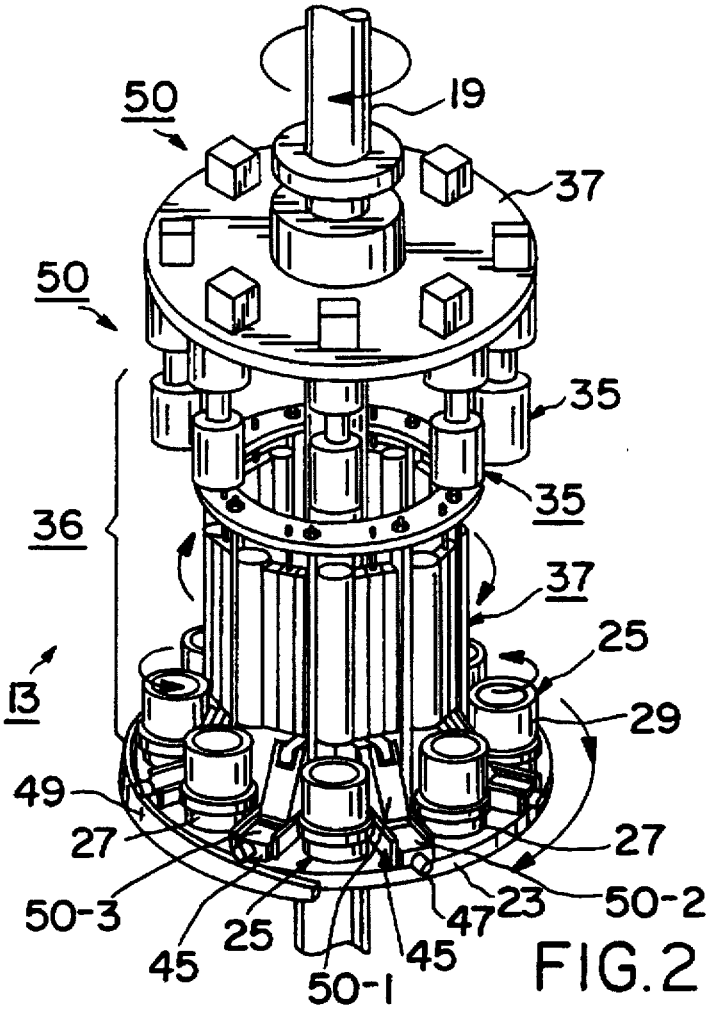
FIG. 2 is a perspective view of the turret in the apparatus shown in FIG. 1 and motors associated with the turret.
Figure 2A:
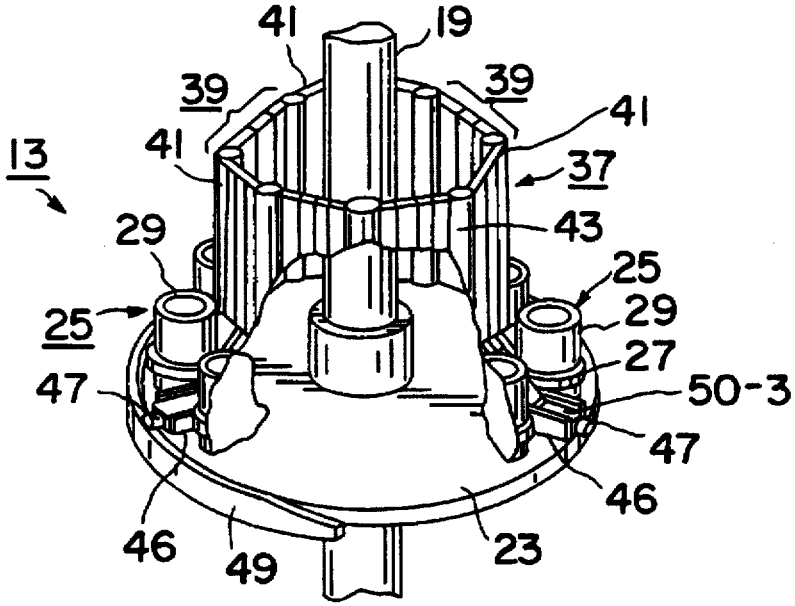
FIG. 2A is a fragmentary perspective view partly broken away of the turret in FIG. 2.

Turret 13, which is also shown separately in FIGS. 2 and 2(A), includes a rotatable central shaft 19 which is housed in a stationary base 20. Shaft 19 is driven by a continuous motor 21 which is coupled to it by belts and pulleys (not shown).

A first platform 23 is fixedly mounted on shaft 19. A plurality of cup assemblies 25 for holding containers $C_{RS}$ to be decorated are mounted on platform 23. Each cup assembly 25 includes a base 27 which is fixedly mounted on platform 23 and a cup 29 having a central axis and which is mounted for rotational movement about its central axis on its associated base 27. Cups 29 are rotably driven by a motor 31 which is coupled to each cup 29 by an arrangement of belts and pulleys (not shown) and a sleeve 33 which is rotably mounted on shaft 19. The direction of rotation of cups 29 is opposite to the direction of rotation of shaft 19 in apparatus 11; however, the direction can be reversed if desired or required by the governing equations for velocity match. Cup assemblies 25 are arranged in a circle around the longitudinal axis of shaft 19. A plurality of nozzle assemblies 35 are mounted on a second platform 37 which is also fixed to central shaft 19, one nozzle assembly being located directly above each cup assembly 25. Nozzle assemblies 35 serve to hold containers to be decorated in cup assemblies 25 firmly in place and provide air to containers $C_{RS}$, if needed, for inflation purposes, such nozzle assemblies being well known in the art. Each cup assembly 25 and its associated nozzle assembly 35 define a container holding assembly or station 36. In turret 13 there am eight containers holding stations 36, the number being for illustrative purposes only.

A label transfer wheel 37 for use in transferring labels from web WA to containers $C_{RS}$ is also mounted on platform 23. Label transfer wheel 37 comprises a plurality of transfer assemblies 39 which are disposed in a circle about the longitudinal axis of shaft 19 and radially inward from container holder assemblies 25. There is one transfer assembly 39 associated with each container holding station. Thus there are eight transfer assemblies 39 in turret 13. Each transfer assembly includes a heater/platen 41 and transfer roller 43. Each heated/platen 41 is coupled to its transfer roller 43 by a bracket (not shown). Each heater/platen 41 is mounted on a cam follower 45. Each cam follower 45 includes a base 46, which is fixed to platform 23, a roller 47 which rides on a cam rail 49 fixedly mounted on bar 20 radially out from platform 23 and a bracket assembly having one leg 50-1 attached to heater/platen 41 and another leg 50-2 attached to leg 50-1 by a pivot pin 50-3 mounted on base 46, roller 47 being attached to leg 50-2. Each label transfer assembly 39 and its associated container holding assembly 36 define a decorating station 50. Thus, there are eight decorating stations 50 on turret 13.

Container transport system 15 includes a crescentine flat top conveyor 51 for transporting containers $C_{RS}$ to and away from turret 13, a feedscrew 53 for positioning and spacing containers $C_{RS}$ being transported on conveyor 51, an input starwheel 55 for transferring containers $C_{RS}$ from feedscrew 53 into container holder assemblies 25, a dragplate 56 under starwheel 55 to provide a surface for dragging container $C_{RS}$ from feedscrew 53 to assemblies 25, sequentially, for decoration and an output starwheel 57 for transferring containers $C_{RS}$ from container holder assemblies 25 back onto conveyor 51 after decoration and a dragplate 58 for providing a surface on which decorated containers are dragged from container holding assemblies 25 to conveyor 51.

Figure 3:
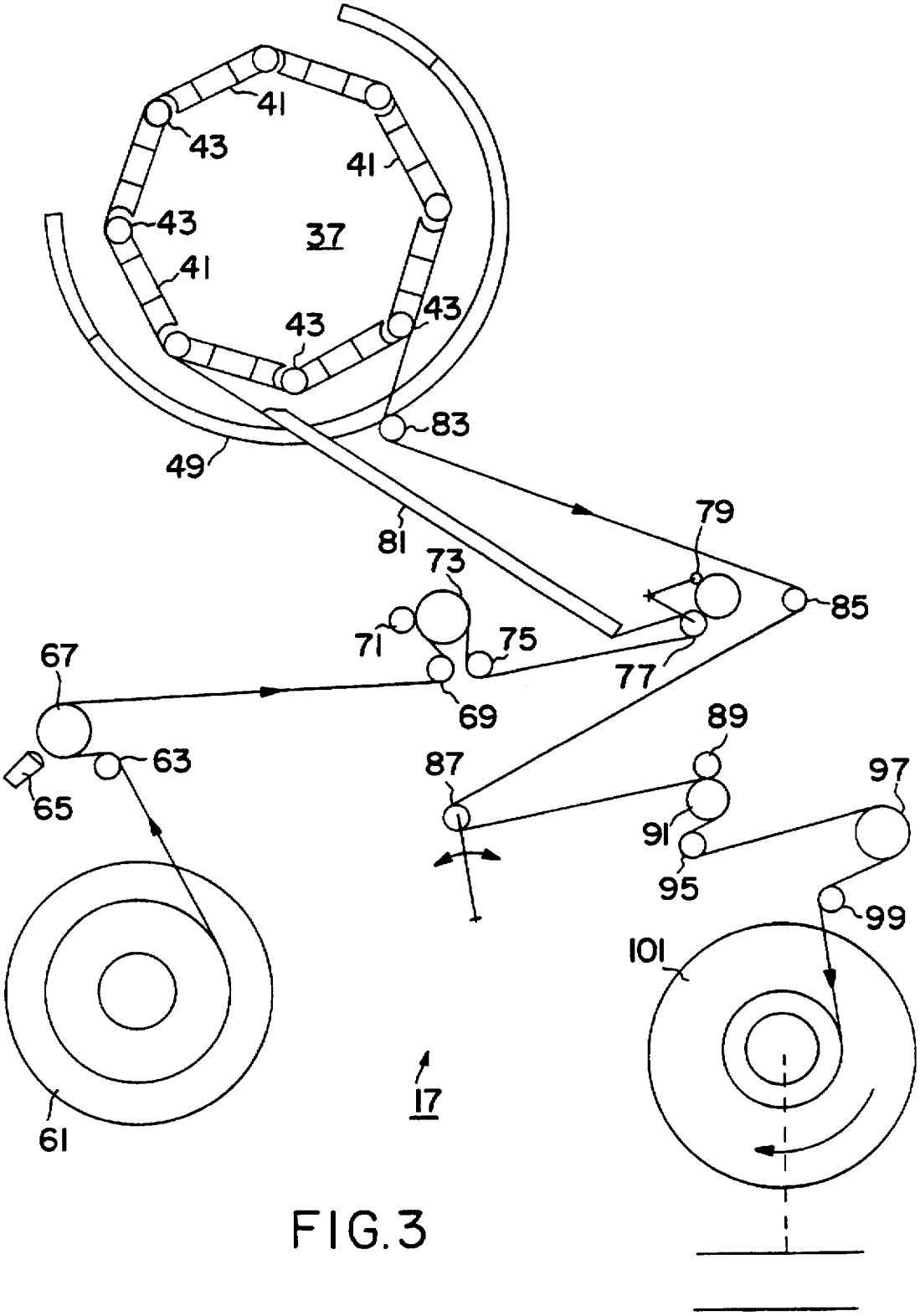
FIG. 3 is a simplified plan view of the web transport assembly and certain other parts of the apparatus in FIG. 1.

Web transport system 17, which is also shown in FIG. 3 includes an unwind spool 61 for holding a web WA carrying heat-transfer labels to be applied to round containers $C_{RS}$. From unwind spool 61, web WA passes around an idler roller 63, by a photo eye 65 and around a tension transducer roller 67, around another idler roller 69 and between a pinch roller 71 and a metering roller 73, around metering roller 73, around another idler roller 75, around a compensating roller 77 controlled by a compensating cam 79 and through a preheater 81. From preheater 81, web WA passes around label transfer wheel 37, around two other idler roller 83 and 85, around a dancer roller 87, between another pinch roller 89 and metering roller 91, around metering roller 91, around another idler roller 95, around another tension transducer roller 97, around another idler roller 99 and to a rewind spool 101. Rewind spool 101 is driven by motor 31.

Feedscrew 53 and starwheels 55 and 57 are driven by motor 21.

Motors 21 and 31 are controlled by electronics 103. In the operation of apparatus 11, containers $C_{RS}$ to be decorated are placed on conveyor 51 from a source (not shown) and transferred by feedscrew 53 and starwheel 55 into holder assemblies 25. At the required time, the transfer assembly 39 associated with a holder assembly 25 is cammed out to push web WA against a container $C_{RS}$ to cause a label to be transferred to the container $C_{RS}$. After decoration, transfer assembly 39 is cammed back in the container is pushed by starwheel 57 along dragplate 58 back onto to conveyor 51. As can be seen, more than one container on turret 13 can be decorated at a time.

Figure 4:
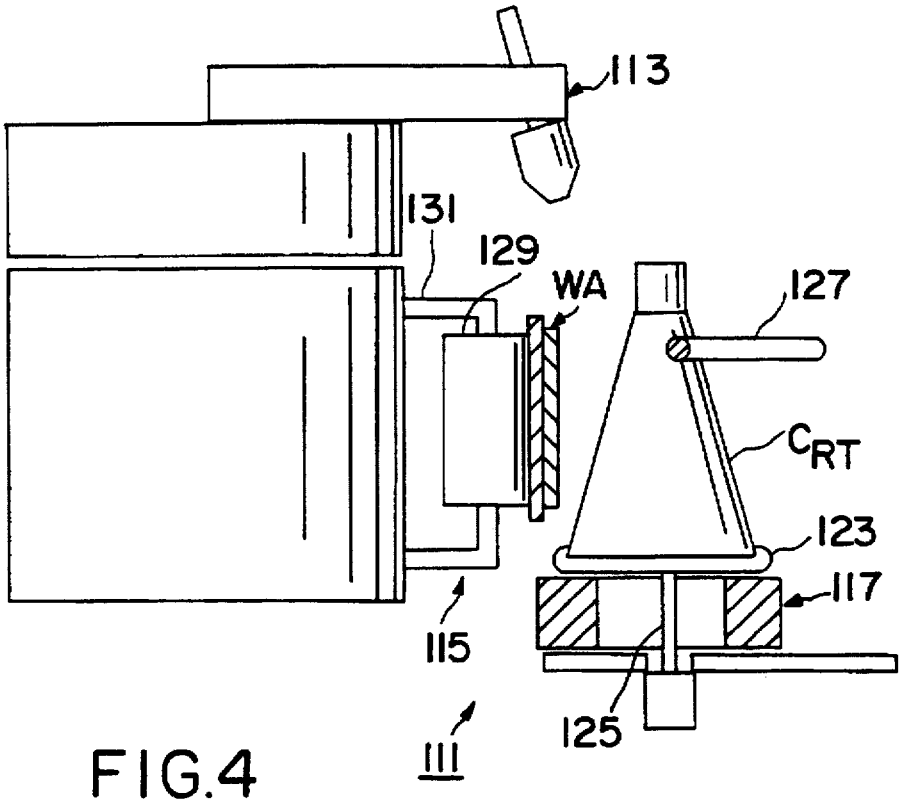
FIG. 4 is a simplified view of a modification of one of the containers holder assemblies shown in the apparatus in FIG. 1, the container holder assembly being disposed in a vertical position.
Figure 5:
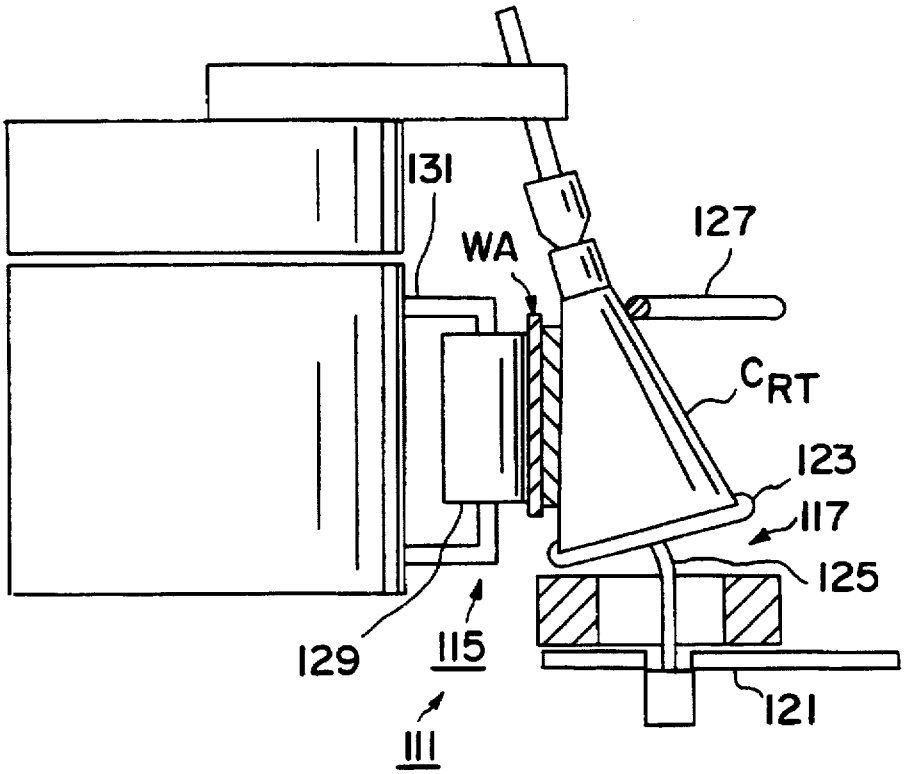
FIG. 5 is a simplified perspective view of the container holder assembly shown in FIG. 4, disposed in a tipped position.

Referring now to FIGS. 4 and 5 there are shown simplified views partly in section of a modification of the decorating station shown in FIG. 1, for use with the apparatus in FIG. 1 in place of decorating station 50, the decorating station being identified by reference numeral 111 and being for use with containers $C_{RT}$ which are round (in cross-section) but tapered (i.e. conical) rather than straight (i.e. cylindrical). In FIG. 4, station 111 is shown holding a container $C_{RT}$ in an upright position, while in FIG. 5, station 111 is shown holding a container $C_{RT}$ in a tipped position for decoration. A web WA carrying labels is also shown.

Station 111 includes a nozzle assembly 113, a label transfer roller assembly 115 and a cup assembly 117. Nozzle assembly includes a nozzle 119 which is mounted on a support for pivotal movement about a horizontal axis. Cup assembly 117 includes a base 121 and a cup 123 coupled to base through a flexible shaft 125. A camming rail 127 is provided to tip container $C_{RT}$ to the proper position parallel to a transfer roller 129 mounted on platform 23 through a support 131.

In operation, input starwheel 55 accepts containers $C_{RT}$ in a vertical position and tips containers $C_{RT}$ for label transferring by camming rail 127 as they are moving. Exit starwheel 57 accepts tipped containers $C_{RT}$ where they are cammed back vertically before exiting on conveyor 51.

Figure 6:
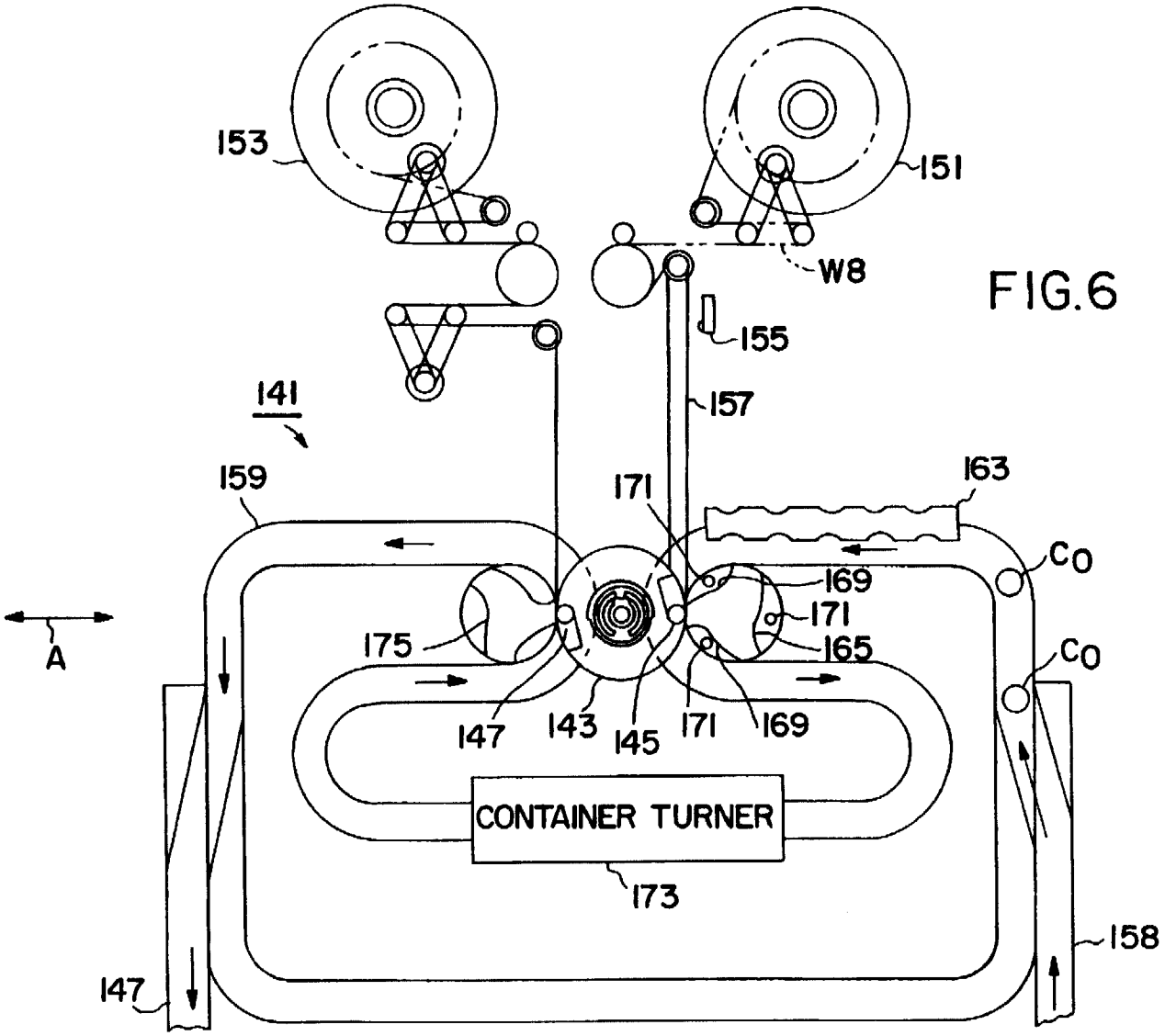
FIG. 6 is a simplified plan view of an apparatus constructed according to this invention for applying heat-transfer labels on a web to oval containers.

Referring now to FIG. 6, there is shown a simplified plan view of an apparatus constructed according to this invention for applying heat-transfer labels form a web W2 to oval shaped containers $C_o$, the apparatus being identified by reference numeral 141.

Apparatus 141 includes a stationary i.e. non-rotatable, label transfer wheel 143 having thereon two label transfer assemblies 145 and 147 disposed around the periphery of label transfer wheel, 180 degrees apart. Label transfer assemblies 145 and 147 each include a roller and a heater/platen and which are mounted on label transfer wheel 143 by any suitable camming mechanism, not shown, so that they can be cammed radially inward and outward relative to the center of label transfer wheel 143. A web WB containing labels for the front and rear of an oval shaped container $C_o$ is wrapped around an arcuate portion of the periphery of label transfer wheel 143, the arcuate portion containing label transfer assemblies 145 and 147. A web transport system 149 is provided for continuously moving web WB around transfer wheel 143. Web transport system 149 includes an unwind spool 151, a rewind spool 153 and a plurality of rollers (not numbered) for directing web WB along a predetermined path and maintaining the proper tension. A registration photoeye 155 and a preheater 157 are disposed along the predetermined path of travel of web WB.

Containers $C_o$ to be decorated are fed from an infeed conveyor 158 onto a continuously moving main conveyor 159 having a double S shaped configuration. From main conveyor 159 containers $C_o$ are fed by a continuously rotating feedscrew 163 onto a first continuously rotating starwheel turret 165. Starwheel turret 165 includes a starwheel 167 having a plurality of pockets 169, each for receiving a container $C_o$ and a plurality of nozzle assemblies 171, one for each pocket 169. As a container $C_o$ in starwheel turret 165 moves toward label transfer assembly 145, the nozzle assembly 171 directly above engages container $C_o$ to hold it in place and provides air, if needed, for inflation. As container $C_o$ passes label transfer assembly 145, label transfer assembly is moved out and the face label applied.

The face decorated container $C_o$ is then released by nozzle assembly 171 and deposited onto main conveyor 159 where it is turned 180 degrees by a container turner 173 and then fed onto a second starwheel turret 175 where the rear label is applied using label transfer assembly 147. After both labels are applied, container $C_o$ is moved onto an exit conveyor 177. As can be appreciated, the front of one container to $C_o$ can be decorated at the same time as the back.

Starwheel turrets 165 and 175 can each be independently adjusted in position along axis A in FIG. 6 in order to match the oval panel radius of the particular container $C_o$ being decorated.

Figure 7:
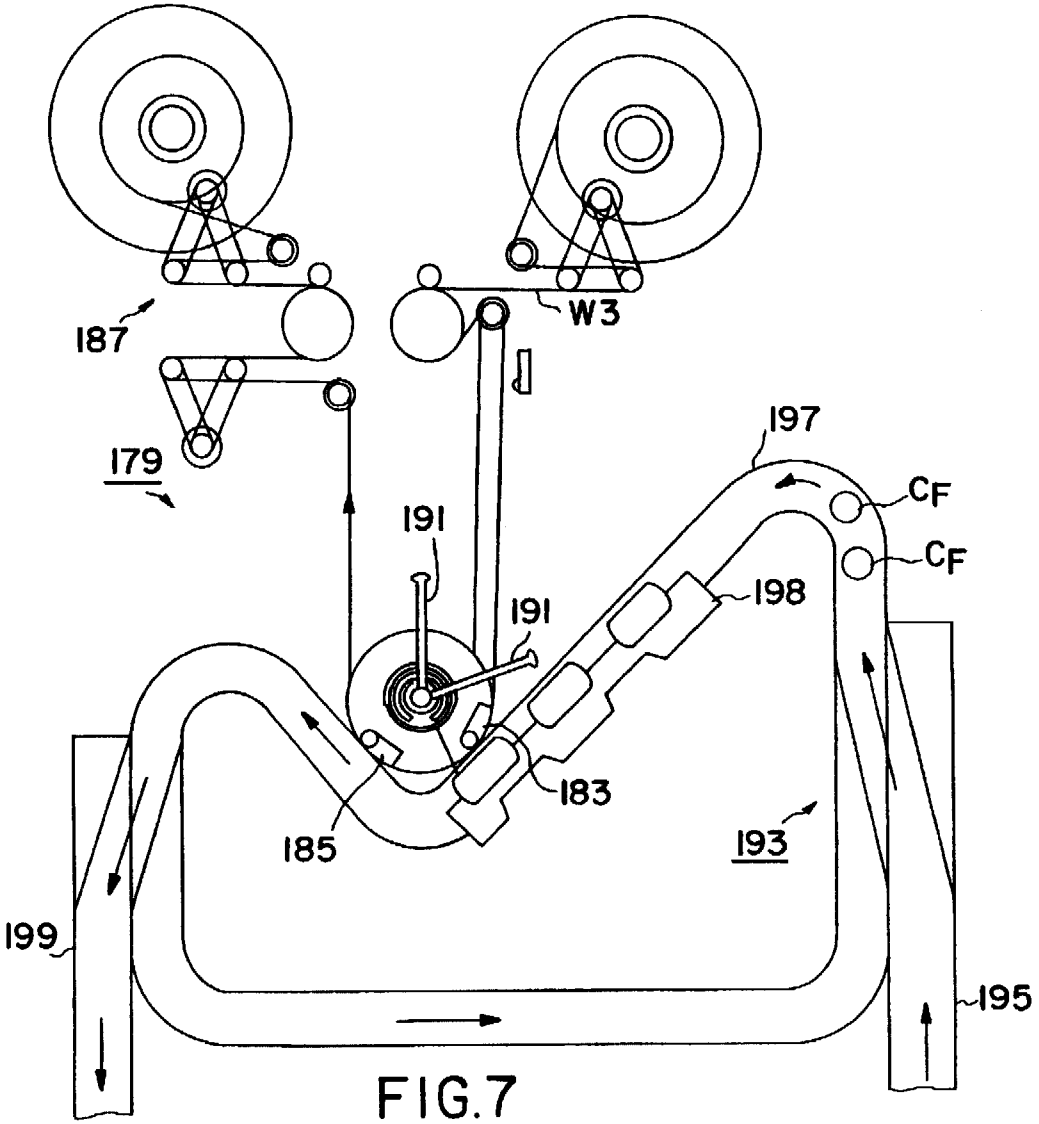
FIG. 7 is a simplified plan view of an apparatus constructed according to this invention for applying heat-transfer labels on a web to flat containers.

Referring now to FIG. 7 there is shown a simplified plan view of an apparatus constructed according to this invention for applying heat transfer labels from a web W3 to flat shaped containers $C_F$, the apparatus being identified by reference numeral 179.

Web W3 contains alternately disposed front and rear labels and extends partially around a stationary label transfer wheel 181 having a pair of label transfer assemblies 183 and 185 which can be cammed radially in and out by any suitable camming means, not shown. Web W3 is moved by a web transport system 187 identical to web transport system 149. A nozzle arm wheel 189 is mounted for rotation about the center of label transfer wheel 181 in the same direction of movement of web W3. A plurality of nozzle arm assemblies 191 are mounted on nozzle arm wheel 189. Each nozzle arm assembly is adapted to hold a container $C_F$ and also turn the container 180 degrees when appropriate.

Containers $C_F$ are transported to and from label transfer wheel 181 by a container conveyor system 193 which includes an infeed conveyor 195, a main conveyor 197, a timing screw 198 along the path of main conveyor 197 and an exit conveyor 199.

Figure 8:
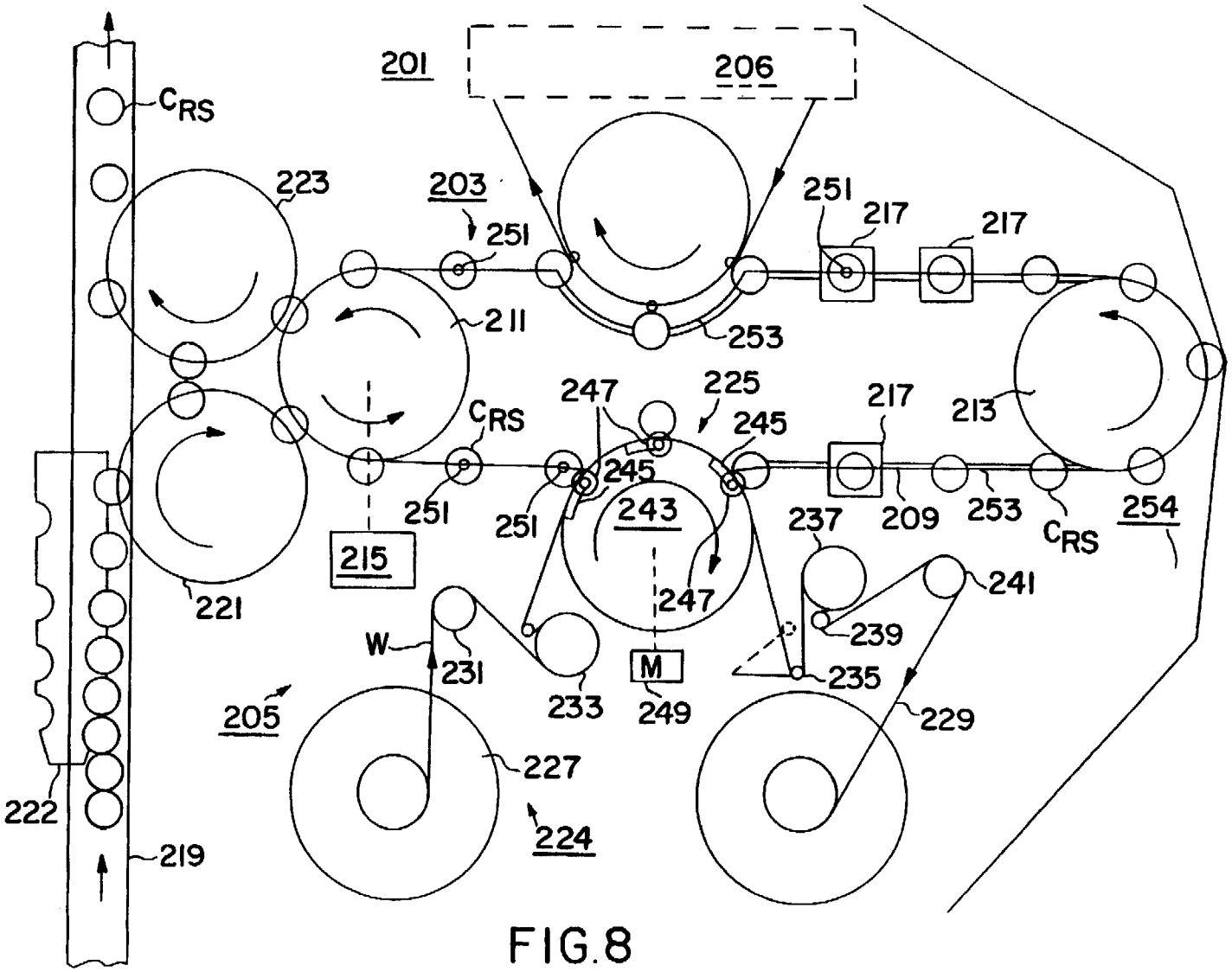
FIG. 8 is a simplified plan view of another embodiment of an apparatus constructed according to this invention for applying heat-transfer labels on a web to round containers.

Referring now to FIG. 8 there is shown a simplified plan view of another embodiment of an apparatus according to this invention for applying heat transfer labels to round, straight containers $C_{RS}$, the apparatus being identified by reference numeral 201.

Apparatus 201 includes a container positioning system 203 for positioning containers $C_{RS}$ at conveying and decorating stations, a pair of web modules 205 and 206 for registration and application of labels and a container transport system 207 for transporting containers to and from the container positioning system 203.

Container positioning system 203 includes a link type chain 209 for moving container $C_{RS}$ along a defined closed loop path. Chain 209 is mounted on a chain drive wheel 211 at one end and a tension wheel 213 at the other end. Chain drive wheel 211 is driven by a continuous motor 215 having a tachometer and encoder for providing speed and position information to web modules 205 and 206. A plurality of container holding assemblies 217 are attached to chain 209 at equally spaced apart distances. For convenience, only a few of assemblies 217 are shown. Each container holding assembly 217 includes a nozzle assembly and a cup assembly. Each nozzle assembly includes a nozzle which can be rotated about its central axis. Each cup assembly includes a cup which is rotatable about its central axis. Containers in container holding assemblies are rotated during chain travel by a pulley (which may be mounted to the station shaft) with a fixed or driven belt. During decoration the drive to the stations is provided by the nozzle assemblies which are independently driven by a separate motor.

Containers $C_{RS}$ are delivered to chain 209 for decoration and carried away from chain 209 after decoration by container transport system 207. Container transport system 207 includes a conveyor 219 for moving containers $C_{RS}$, an infeed starwheel 221 for depositing containers $C_{RS}$ into the cup assemblies, a feedscrew 222 for depositing containers $C_{RS}$ from conveyor 219 onto infeed starwheel 221 and an exit starwheel 223 for depositing decorated containers $C_{RS}$ from container accepting cup 217 back onto conveyor 219.

Container web module 205 includes a label registration assembly 224 and a label transfer unit 225.

Registration assembly 224 includes an unwind spool 227 for holding a supply of web material W, a rewind spool 229 and a plurality of rollers 231 through 241 which support web W and precisely control web movement which is electronically synchronized with cup movement and position. Label transfer unit 225 includes a rotably mounted wheel 243 having a plurality of label transfer assemblies 245 which can be cammed radially inward and outward by any suitable camming means, not shown, and a plurality of nozzles assemblies 247 for capturing containers $C_{RS}$ when they arrive at wheel 243. A continuous motor 249 drives wheel 243. Chain 209 is guided around wheel 243 by a plurality of cam followers 251 which are mounted on chain 209 and which ride in a cam slot 253 in a multi-plate cam slot assembly 254, only a portion of which is shown in FIG. 8.

Web module 206 differs from web module 205 only in that it may have different labels on its web W. For example, web W in module 205 may contain labels for decorating the body portion of a container $C_{RS}$ while web W in module 206 may contain labels for decorating the neck portion of a container $C_{RS}$.

Figure 9:
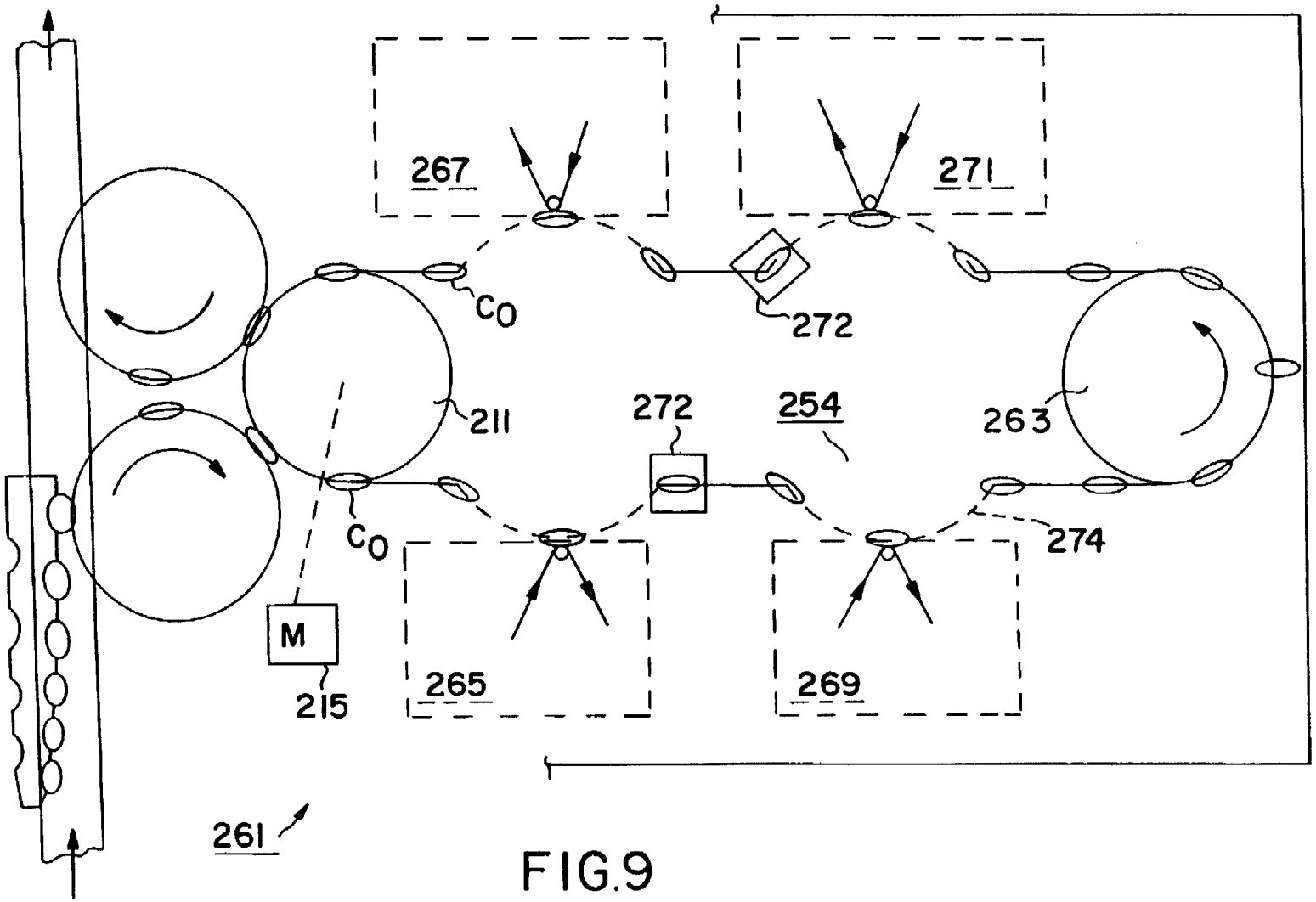
FIG. 9 is a simplified plan view of another embodiment of an apparatus constructed according to this invention to applying heat-transfer labels on a web to oval containers.
Figure 10:
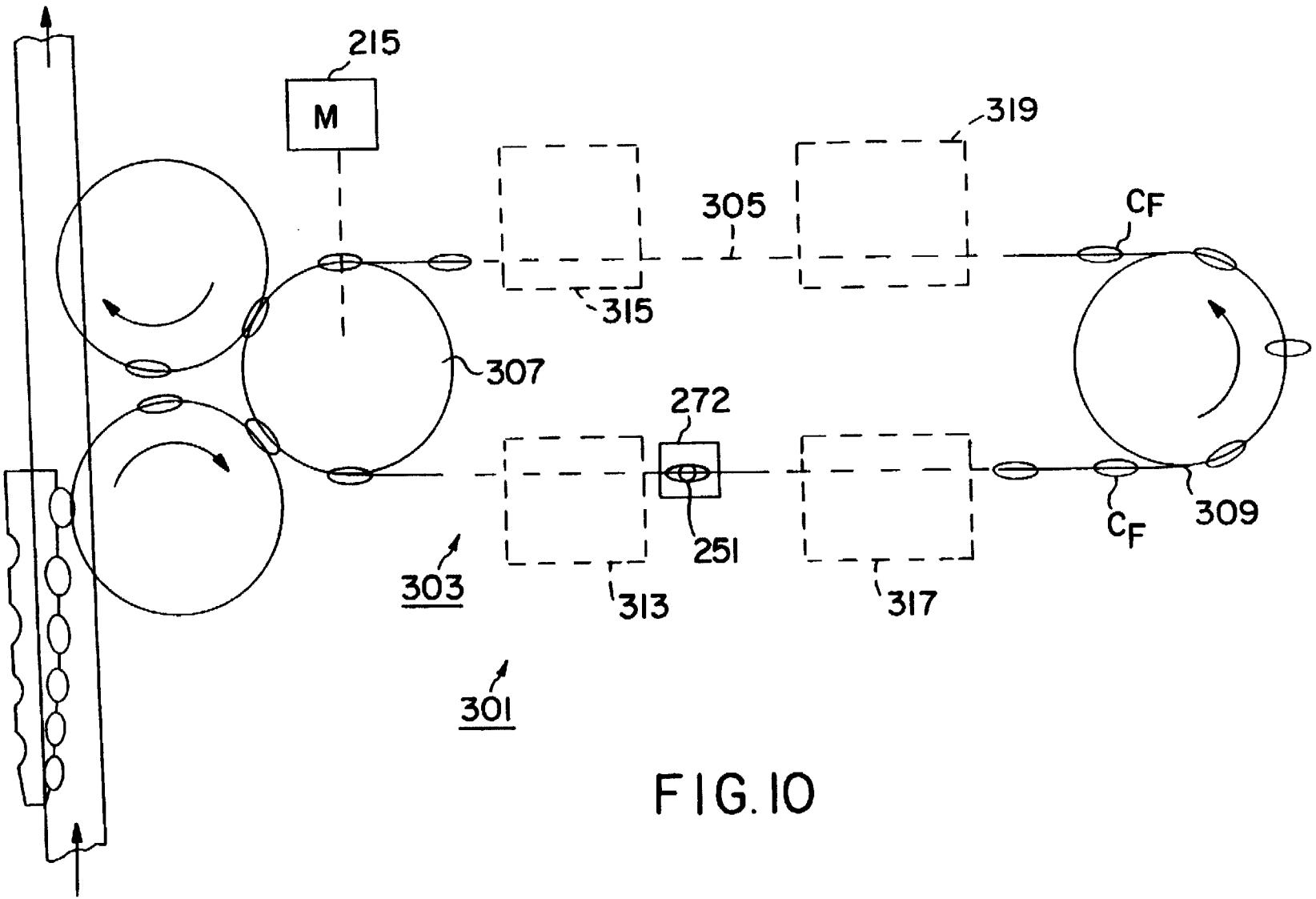
FIG. 10 is a simplified plan view of another embodiment of an apparatus constructed according to this invention to applying heat-transfer labels on a web to flat containers.

Apparatus 201 can be easily converted into an apparatus for decorating oval or flat objects as shown in FIGS. 9 and 10.

Referring now to FIG. 9, there is shown a simplified plan view of a modification of the apparatus shown in FIG. 8 for use in applying heat transfer labels to oval shaped containers Co, the apparatus being identified by reference numeral 261. Apparatus 261 differs from apparatus 201 in that tension wheel 213 has been replaced by a combination tension wheel and container turner 263, web modules 205 and 206 have been replaced by web modules 265, 267, 269 and 271, holder assemblies 217 have been replaced by holder assemblies 272. For convenience only two holder assemblies 272 are shown in FIG. 9 and cam slot assembly 254 has been replaced by a multi-plate cam slot assembly 273 having convex arcuate slot portions 274 rather than concave arcuate portions as in assembly 254. The cam slot radius of the arcuate slot portions 274 is such that the container surface traces a radial path which is equal to the radius of the container surface. Web modules 265 through 271 include unwind and rewind spools for holding a length of web material and a plurality of rollers for supporting the web and precisely controlling web movement (all not shown) and a movable label transfer assembly 273 having a roller and a heater/platen and may be similar in construction to web module 100 shown in U.S. Pat. No. 4,735,664. Web modules 265 and 267 may be used to apply a label to the front and rear, respectively, of a container Co while web modules 269 and 271 may be auxiliary modules activated only when desired i.e. when modules 265 and/or 267 are being refilled with web material. Thus, essentially no time is lost when a web module runs out of web material or suffers a mechanical or electrical failure.

Referring now to FIG. 10, there is shown a simplified plan view of a modification of the apparatus shown in FIG. 9 for use in applying heat-transfer labels to flat containers $C_F$, the modified apparatus being identified by reference numeral 301.

Apparatus 301 includes a container positioning system 303 having a link chain 305 similar to chain 209, a chain drive wheel 307 and a tensioner and container turner 309 similar to chain drive wheel 211 and a combination tensioner and container turner 263, a container transport system 311 similar to container transport system 207 and four web modules 313, 315, 317 and 319 similar to web modules 265, 267, 269 and 271. Apparatus 301 differs from apparatus 261 in that link chain 305 travels along a straight path from chain drive wheel 307 to container 309 and back rather than a path that is partially curved.

The embodiments of the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. Apparatus for applying heat transfer labels, disposed on a web, to round containers comprising:

a. a continuously rotating turret, said turret having thereon a plurality of decorating stations at which labels can be transferred from said web to said containers, each decorating station including an a container holding assembly having a continuously rotating cup and a label transfer assembly, said label transfer assembly including a transfer roller and a heater/platen, said heater/platen being coupled to said transfer roller, b. means for moving said web along a path which passes through at least two of said plurality of decorating stations, c. means for delivering containers to be decorated to said continuously rotating turret and carrying away containers from said continuously rotating turret after decoration, d. a first motor for driving said continuously rotating turret and said delivering means, and e. a second motor for driving said continuously rotating cup and said web moving means.

2. Apparatus for applying heat transfer labels, disposed on a web, to round containers, comprising:

a. means for moving the web along a web path, said web path having a label transfer portion, b. a plurality of container holding assemblies continuously movable along a container holding path adjacent the label transfer portion, each container holding assembly being adapted to hold a container to be decorated and being rotable, c. a plurality of label transfer assemblies disposed adjacent said label transfer portion of said web path, cam means for moving each label transfer assembly into contact with the web and to cause a label to transfer from the web to a container in a container holding assembly, at least two of said containers in said container holders being decorated simultaneously, and d. means for delivering containers to be decorated to said container holders, sequentially and carrying away containers after decoration, sequentially.

3. Apparatus for applying heat transfer labels, disposed on a web, to round containers comprising:

a. a turret, said turret having:

i. a rotatable central shaft, ii. a platform fixed to said rotatable central shaft, iii. a plurality of cup assemblies for receiving and holding containers to be decorated, each cup assembly including a base and a cup mounted on said base for rotation about its central axis, iv. means for mounting said cup assemblies in a circle about said central axis on said platform, v. a label transfer wheel, said label transfer wheel including a plurality of label transfer assemblies the number of label transfer assemblies being equal to the number of cup assemblies, the radius of the label transfer wheel being less than the radius of the circle of cup assemblies, vi. means for mounting said label transfer wheel on said platform about said central axis, b. a web transport assembly for moving said web at a predetermined speed and position along a web path which passes between at least some of said cup assemblies and at least some of said label transfer assemblies, c. means for delivering containers to be decorated to said turret and carrying away containers from turret after decoration, and d. cam means for moving label transfer assemblies into and out of contact with said web.

4. Apparatus for applying heat transfer labels disposed on a web to containers comprising:

a. a stationary circular base;

b. a pair of label transfer assemblies circumferentially disposed on said base;

c. a web transport system for transporting a web containing heat transfer labels along a path which passes around said pair of label transfer assemblies; and d. a container transport system for transporting containers to be decorated along a path which passes adjacent said pair of label transfer assemblies, said container transport system including a container turner for turning the container 180 degrees.

5. A method of applying heat transfer labels, disposed on a web, to round containers, comprising:

a. continuously moving the web along the web path, said web path having a label transfer portion, b. continuously moving a plurality of container having assemblies along a container holding path adjacent the label transfer portion, each container holding assembly being adapted to hold a container to be decorated and being rotable, c. proving a plurality of label transfer assemblies disposed adjacent said label transfer portion of said web path, each label transfer assembly being movable into and out of contact with the web to cause a label to transfer from the web to a container in a container holding assembly, at least two of said containers in said container holders being decorated simultaneously, and d. delivering containers to be decorated to said container holders, sequentially and carrying away containers after decoration, sequentially.

6. The apparatus of claim 1 and further including cam means for moving said transfer roller and said heater/platen into and out of contact with said web.

7. The apparatus of claim 3 wherein said cam means comprises a cam rail and a cam follower.

8. The apparatus of claim 7 wherein one cam follower is associated with each label transfer assembly.

* * * * *